US006128786A

United States Patent [19]

Maddux et al.

[11] Patent Number: 6,128,786

[45] **Date of Patent: *Oct. 10, 2000**

[54] ONE-SIZE-FITS-ALL HELMET

[75] Inventors: Larry E. Maddux, Knoxville, Tenn.; Thad M. Ide, Beaverton, Oreg.

[73] Assignee: HOS Development Corporation, Litchfield, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/951,350

[22] Filed: Oct. 16, 1997

[51] Int. Cl.[7] ..... A42B 3/10

[52] U.S. Cl. ..... 2/418; 2/425

[58] Field of Search ..... 2/410, 411, 414, 2/416, 417, 418, 420, 425, 183

[56] References Cited

U.S. PATENT DOCUMENTS

| | | | |
|---|---|---|---|
| 2,250,275 | 7/1941 | Riddell . | |
| 2,420,522 | 5/1947 | Le Grand Daly . | |
| 2,617,988 | 11/1952 | Alesi . | |
| 2,706,294 | 4/1955 | Sprinkle . | |
| 2,739,310 | 3/1956 | Frieder . | |
| 2,822,546 | 2/1958 | Barker, Jr. . | |
| 2,939,149 | 6/1960 | Morgan, Jr. . | |
| 2,969,546 | 1/1961 | Morgan, Jr. . | |
| 2,983,923 | 5/1961 | Aileo . | |
| 3,042,927 | 7/1962 | Mauro et al. . | |
| 3,087,166 | 4/1963 | Howard . | |
| 3,107,356 | 10/1963 | Pestronk et al. . | |
| 3,111,674 | 11/1963 | Marietta . | |
| 3,183,522 | 5/1965 | Groot . | |
| 3,289,212 | 12/1966 | Morgan . | |
| 3,305,874 | 2/1967 | Pehan . | |
| 3,374,299 | 3/1968 | Pehan . | |
| 3,465,363 | 9/1969 | Raney . | |
| 3,486,169 | 12/1969 | Rawlings . | |
| 3,510,879 | 5/1970 | Webb . | |
| 3,590,388 | 7/1971 | Hoh . | |
| 3,600,713 | 8/1971 | Hoh . | |
| 3,605,113 | 9/1971 | Marietta . | |
| 3,609,765 | 10/1971 | Molitoris . | |
| 3,729,745 | 5/1973 | Latina . | |
| 3,732,574 | 5/1973 | Hale . | |
| 3,950,788 | 4/1976 | Lamb . | |
| 4,000,520 | 1/1977 | Svendsen et al. | 2/418 |
| 4,287,613 | 9/1981 | Schulz . | |
| 4,407,021 | 10/1983 | Kralik et al. . | |
| 4,627,114 | 12/1986 | Mitchell . | |
| 4,901,373 | 2/1990 | Broersma . | |
| 4,932,076 | 6/1990 | Giorgio et al. . | |
| 5,093,936 | 3/1992 | Copeland et al. . | |
| 5,142,705 | 9/1992 | Edwards . | |
| 5,315,718 | 5/1994 | Barson et al. . | |
| 5,575,017 | 11/1996 | Hefling et al. . | |
| 5,694,649 | 12/1997 | Hefling et al. | 2/418 |

OTHER PUBLICATIONS

Copies of nine photographs of batters helmet by the Rawlings Company. Though the date of first public disclosure of the Rawlings helmet shown in the nine photographs is unknown, it is believed that the Rawlings helmet shown was available to the public prior to Oct. 16, 1997.

"Cooper Spring & Summer 1996 U.S.A." catalog published by Cooper, front and back cover sheets and p. 8, 1996.

*Primary Examiner*—Michael A. Neas

*Attorney, Agent, or Firm*—Brinks Hofer Gilson & Lione

[57] ABSTRACT

A helmet to be worn on a person's head where the helmet includes a shell having a front surface, a rear surface, a first side surface and a second side surface, wherein the front, rear, first side and second side surfaces define an interior space. The helmet further includes a strap with a first end attached to the shell and a second end attached to the shell, wherein the strap forms a II-shaped receptor within the interior space.

64 Claims, 11 Drawing Sheets

154
72
38
20
156
118
136
150
24
32
60
62
158
46
64
66
48
160
34
50
52
84
84
70
22
28
26
100

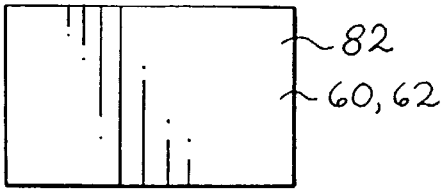
Fig. 9A
Fig. 9B
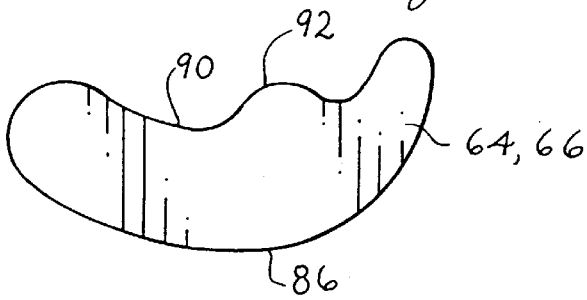
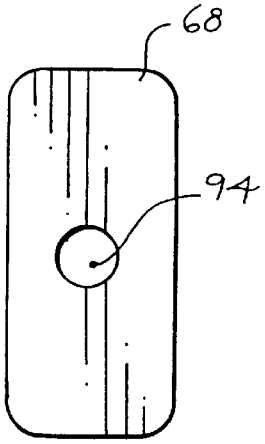
Fig. 9C
Fig. 9D
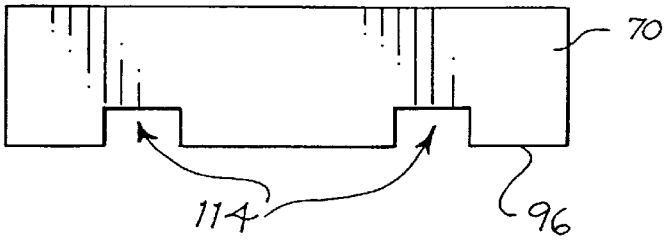
Fig. 9E
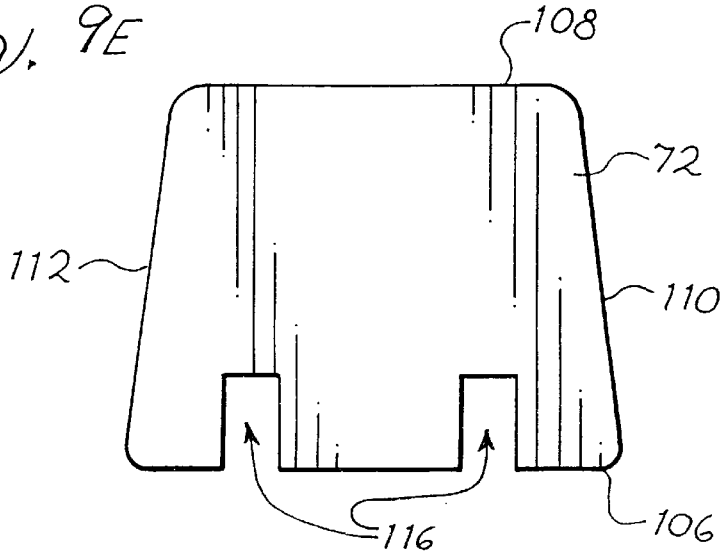

ONE-SIZE-FITS-ALL HELMET

BACKGROUND OF THE INVENTION

1. Field of the Invention

This invention relates to helmets for wearing during sports play and more particularly to helmets that fit a wide range of head sizes.

2. Discussion of Related Art

Baseball helmets are commonly used and are required for league play, as a hard thrown baseball pitch or a bat deflected ball striking a batter's unprotected head may cause injury and even death. While no batter's helmet may totally prevent head injuries, they can reduce the severity of the injury and in many cases prevent injury. Baseball batters' helmets generally use a shell with a crown portion, a forwardly projecting bill and rigid earflaps extending downwardly and forwardly to protect the sides of the head.

Helmets are available in different sizes so as to properly fit the different sized heads of the players of a baseball team. Baseball team rosters may have as many as twenty players on them. Accordingly, it can be quite expensive to supply each player with a helmet that fits his or her head. While it is common for professional, semi-professional, college and even high school teams to spend the money necessary to assign a helmet to each player, such is not the usual case with youth leagues, such as the league known by the trade mark Little League®, where budgets can force the youth league to look for alternative ways to deal with outfitting the players with helmets.

One way youth leagues can outfit a team of players is to use helmets that may be adjusted to particular head sizes by the use of removable and replaceable pads within a standard size of helmet shell. Such helmets, such as those helmets made by Park View Manufacturing, Inc. of Salem, Ill. under the trade names of AIR® Pro 2700, AIR® Pro 2788 and AIR® Pro 2800, may suffer from the disadvantage that the pads can be easily lost.

Another solution to outfitting youth leagues is to use tile helmets. However, tile helmets are often too floppy and tend to fall down over the eyes of the wearer. The helmets also often fall off during base running, leaving the runner vulnerable to head injury if hit by a ball thrown to the baseman.

U.S. Pat. No. 5,575,017 describes an adjustable baseball helmet that uses a V-shaped elastic band or strap to cradle the helmet on a batter's head. The helmet 300 is schematically shown in FIGS. 1A–B. One disadvantage of that helmet is that it fits loosely at the rear. As shown in FIG. 1B, when the head 302 is cradled by the elastic band the rear part of the head is unsupported by the elastic band 304 which results in the helmet 300 shifting from the front to the back during play.

SUMMARY OF THE INVENTION

One aspect of the present invention regards a helmet to be worn on a person's head where the helmet includes a shell having a front surface, a rear surface, a first side surface and a second side surface, wherein the front, rear, first side and second side surfaces define an interior space. The helmet further includes a strap with a first end attached to the shell and a second end attached to the shell, wherein the strap forms a II-shaped receptor within the interior space.

A second aspect of the present invention regards a helmet to be worn on a person's head where the helmet includes a shell with a front surface, a rear surface, a first side surface and a second side surface, wherein the front, rear, first side and second side surfaces define an interior space. The helmet further includes a strap that has a first side section and a second side section attached to the shell and a rear support section attached to the first and second side sections and positioned entirely within the interior space without being directly attached to the shell.

A third aspect of the present invention regards a helmet to be worn on a person's head where the helmet includes a shell with a front surface, a rear surface, a first side surface and a second side surface, wherein the front, rear, first side and second side surfaces define an interior space. The helmet further includes a strap that has a first section with a first end attached to the front surface and a second end attached to the rear surface. The strap has a second section with a third end attached to the front surface and a fourth end attached to the rear surface and a rear support section with a first end attached to the first section of the strap and a second end attached to the second section of the strap.

A fourth aspect of the present invention regards a helmet to be worn on a person's head where the helmet includes a shell with a front surface, a rear surface, a first side surface and a second side surface, wherein the front, rear, first side and second side surfaces define an interior space. The helmet further includes a one-piece strap that has a first section attached to the front surface and extending towards the rear surface along a first direction and a second section integrally attached to the first section and extending towards the rear surface along a second direction. The strap also has a third section integrally attached to the second section and extending towards the front surface along a third direction, a fourth section integrally attached to the third section and extending towards the first side surface along a fourth direction and a fifth section integrally attached to the fourth section and extending towards the rear surface along a fifth direction. In addition, the strap includes a sixth section integrally attached to the fifth section and extending towards the front surface along a sixth direction and a seventh section integrally attached to the sixth section and extending towards the front surface along a seventh direction and attached to the front surface.

Each aspect of the present invention provides the advantage of allowing a single helmet to snugly fit a variety of sizes of players' heads.

Each aspect of the present invention provides a second advantage in that it presents a permanent and non-removable structure that allows a single helmet to snugly fit a variety of sizes of players' heads.

Each aspect of the present invention provides a third advantage in that it provides a structure that provides a snug fit that helps to prevent the helmet from shifting from the front to the back and falling off during base running.

The foregoing features and advantages of the present invention will be further understood upon consideration of the following detailed description of the invention taken in conjunction with the accompanying drawings, in which:

BRIEF DESCRIPTION OF THE DRAWINGS

FIG. 9A shows a top view of a side pad to be used with the helmet of FIG. 2;

FIG. 9B shows a top view of an ear pad to be used with the helmet of FIG. 2;

FIG. 9C shows a top view of a crown pad to be used with the helmet of FIG. 2;

FIG. 9D shows a top view of a front pad to be used with the helmet of FIG. 2;

FIG. 9E shows a top view of a rear pad to be used with the helmet of FIG. 2;

DETAILED DESCRIPTION OF THE PRESENTLY PREFERRED EMBODIMENTS

Figure 7A:
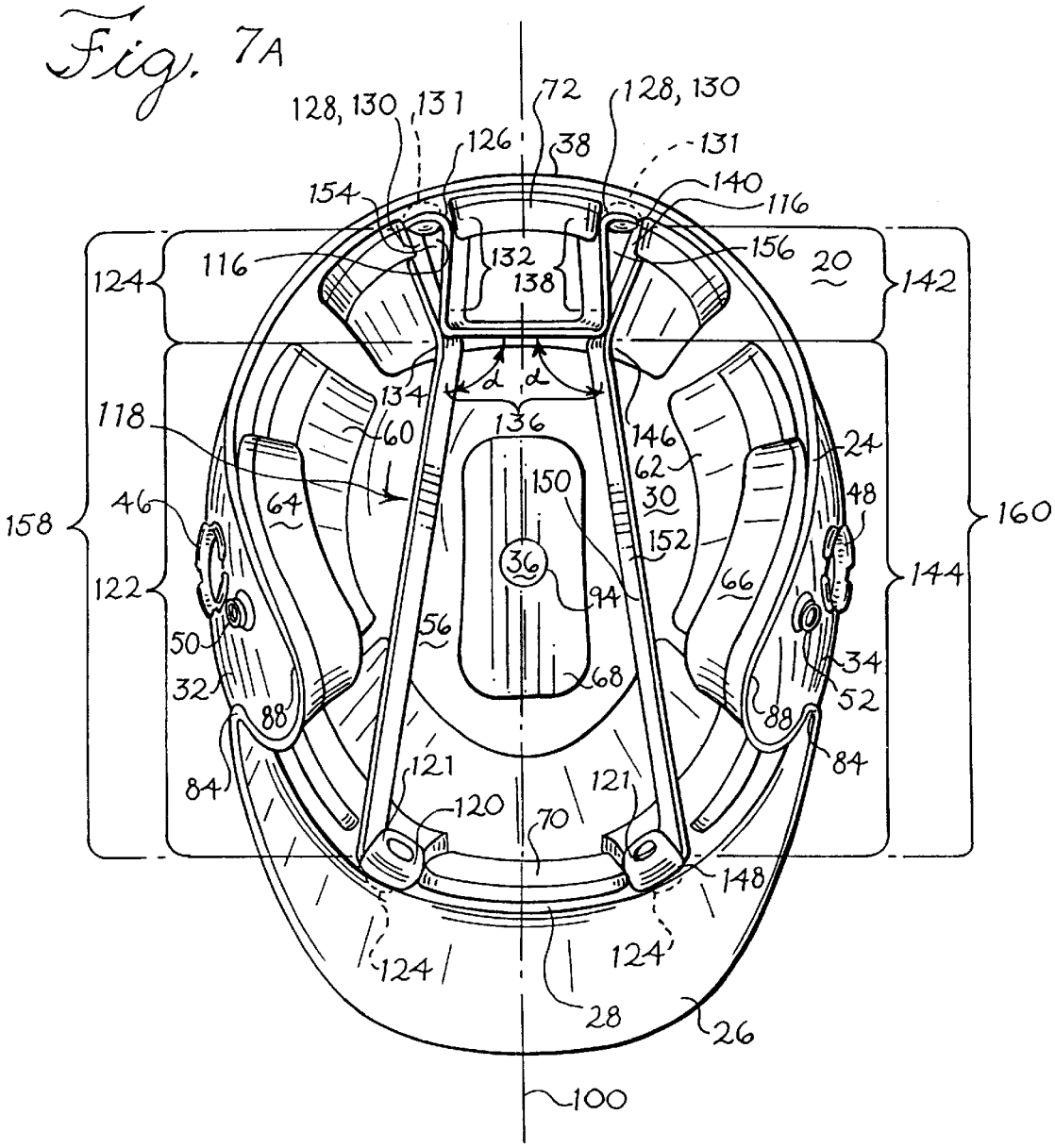
FIG. 7A schematically shows a bottom view of the helmet of FIG. 2 without a head placed therein.
Figure 7B:
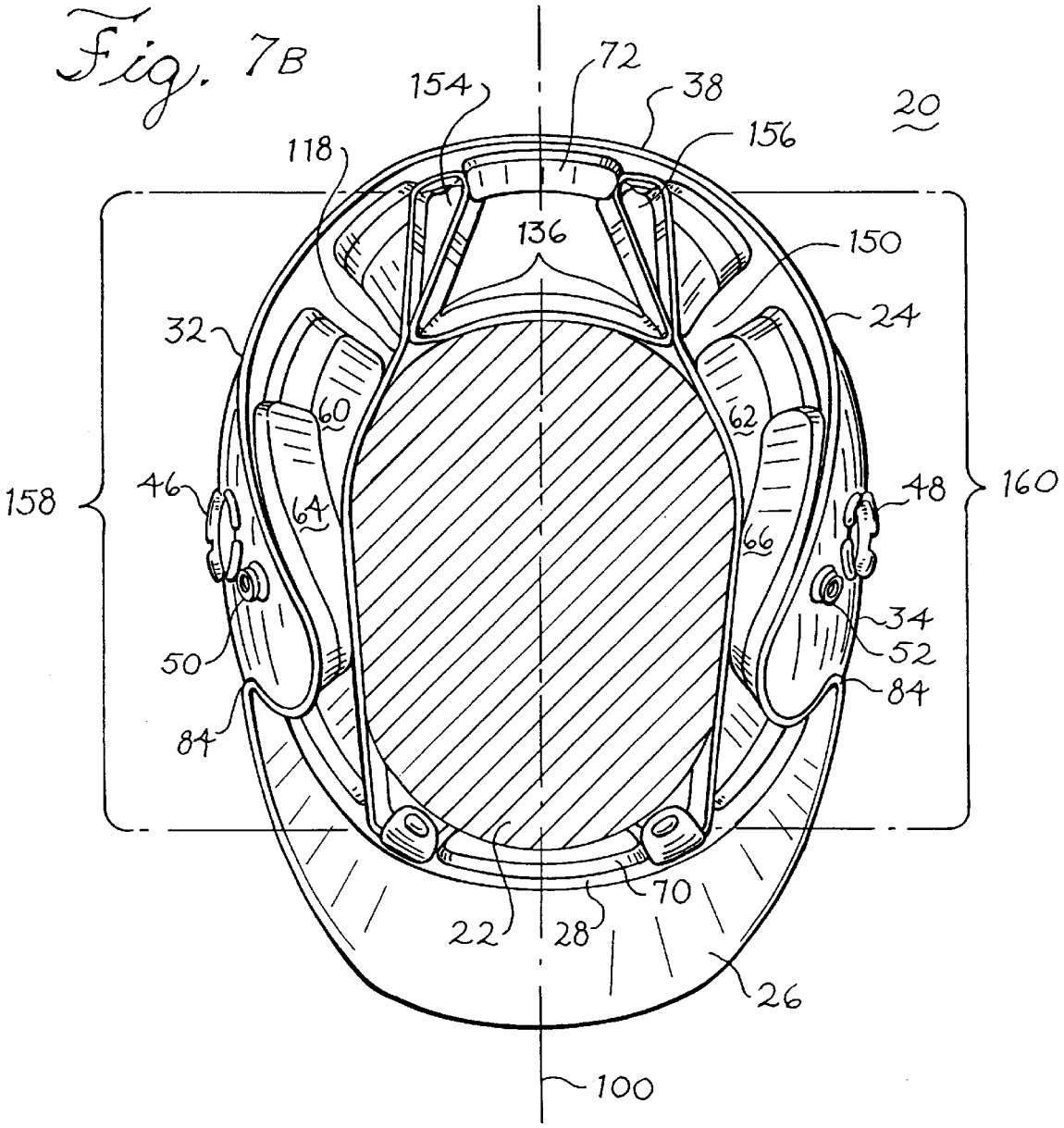
FIG. 7B schematically shows a bottom view of the helmet of FIG. 7A with a head placed therein.
Figure 8A:
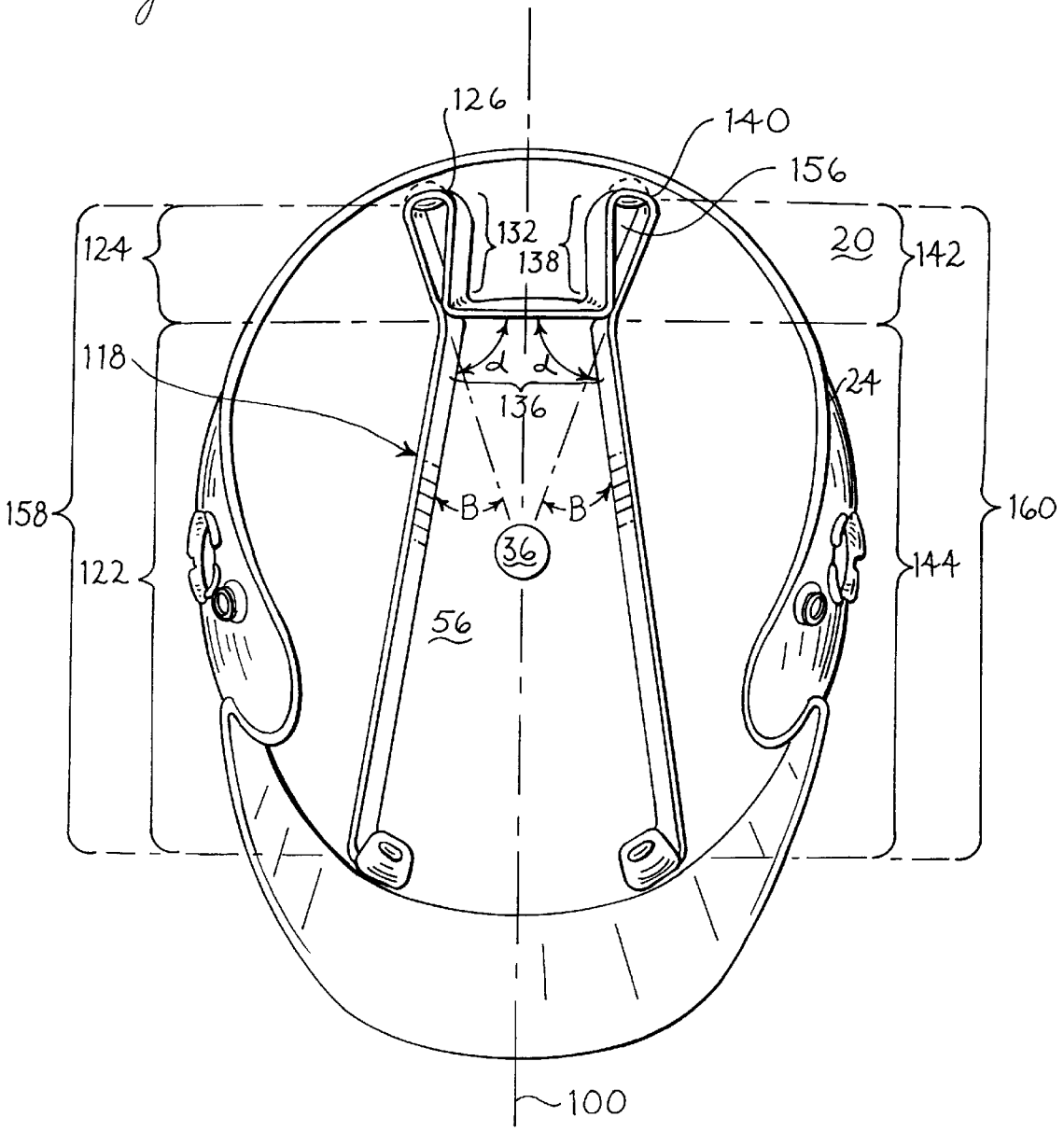
FIG. 8A schematically shows a bottom view of the helmet of FIG. 2 and the orientation of a harness therein.
Figure 8B:
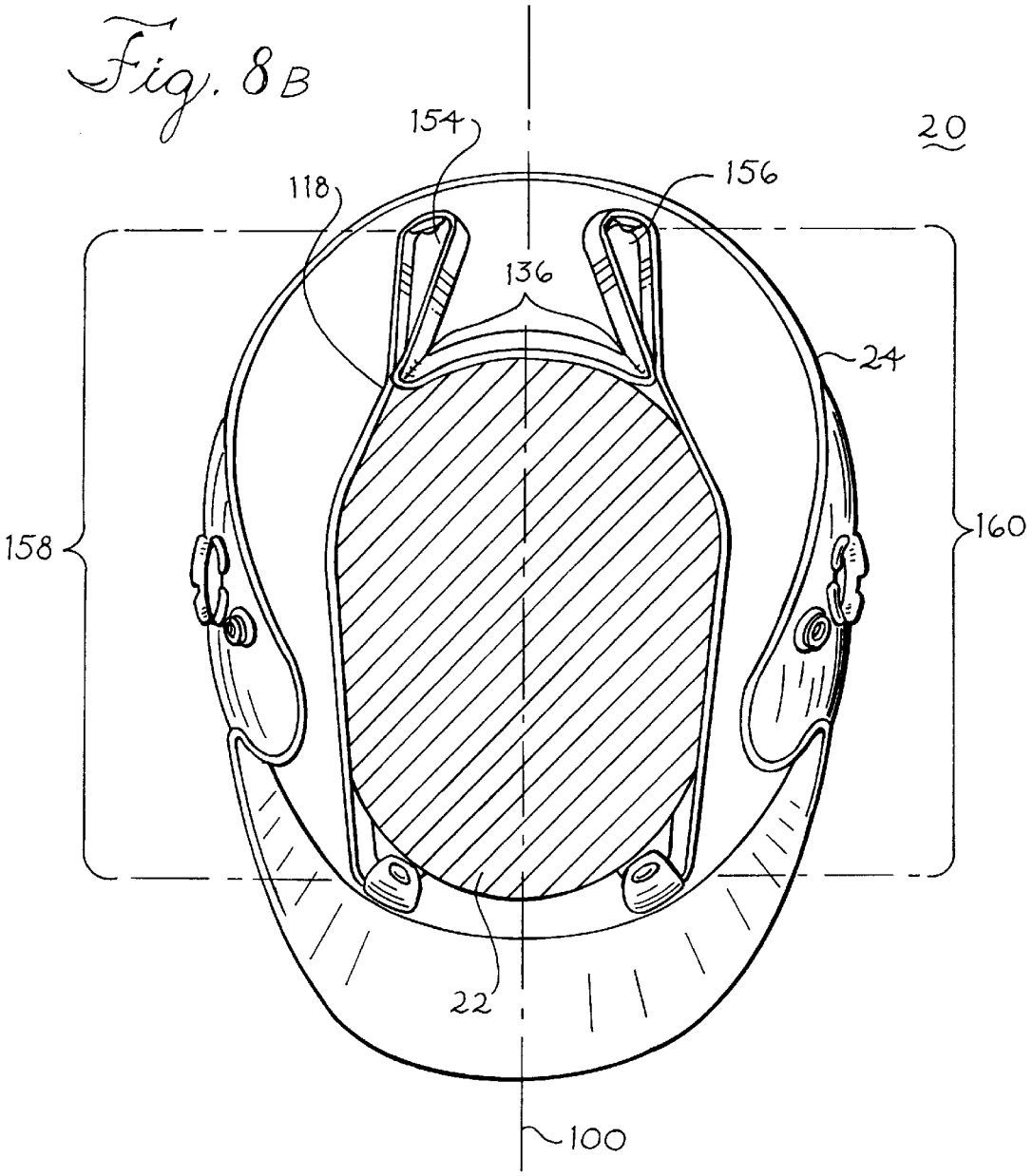
FIG. 8B schematically shows the orientation of the harness of FIG. 8A when a head is placed within the helmet.

Referring now to the drawings wherein like reference characters designate identical or corresponding parts throughout the several figures, and in particular FIGS. 2–15 show a helmet 20 that is designed to be worn on a person's head 22 (see FIGS. 7B and 8B). As shown in FIGS. 2–7, the helmet 20 is composed of a one piece shell 24 that is injected molded in a well known manner from a durable material, such as ABS "CYCOLAC" L-Grade Resin Pellets manufactured by G.E. Plastics of Pittsfield, Mass. Different colored plastics can be used to give the helmet a desired color for a particular team. Team decals can be added if desired.

Figure 1B:
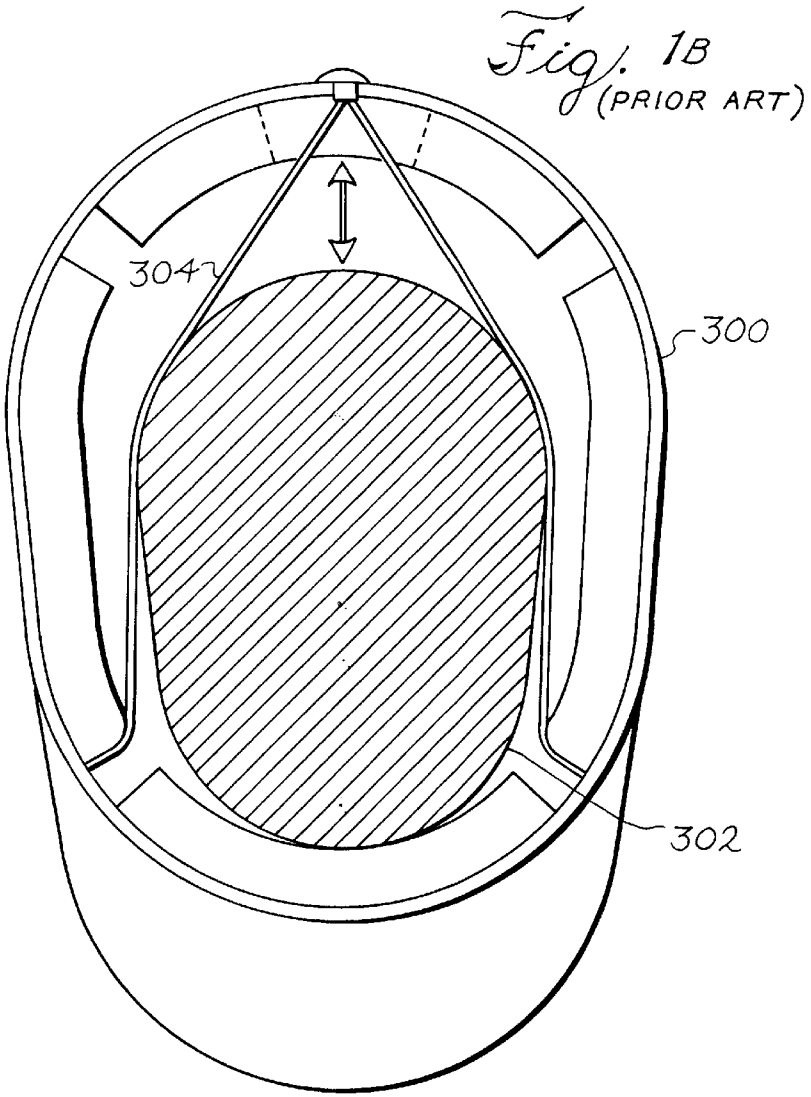
Fig. 1B (PRIOR ART)
FIG. 1B schematically shows a bottom view of the helmet of FIG. 1A with a head placed therein.
Figure 1A:
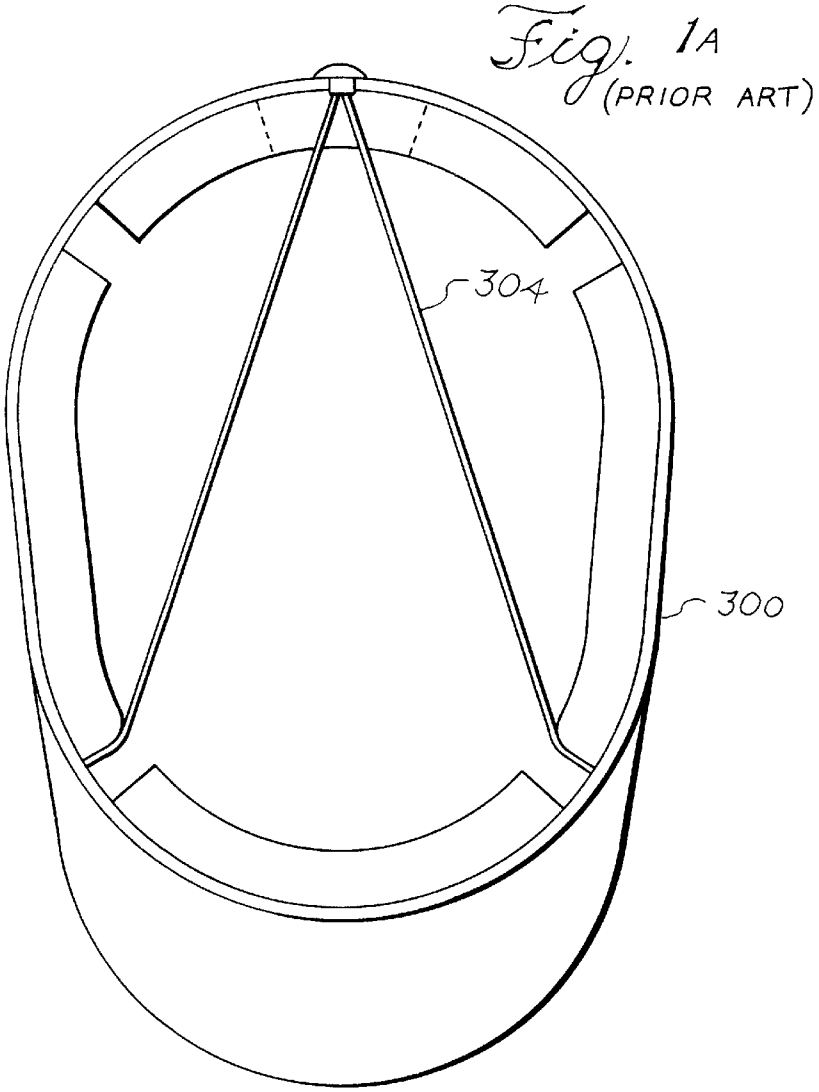
Fig. 1A (PRIOR ART)
FIG. 1A schematically shows a bottom view of a helmet without a head placed therein and described in U.S. Pat. No. 5,575,017.
Figure 2:
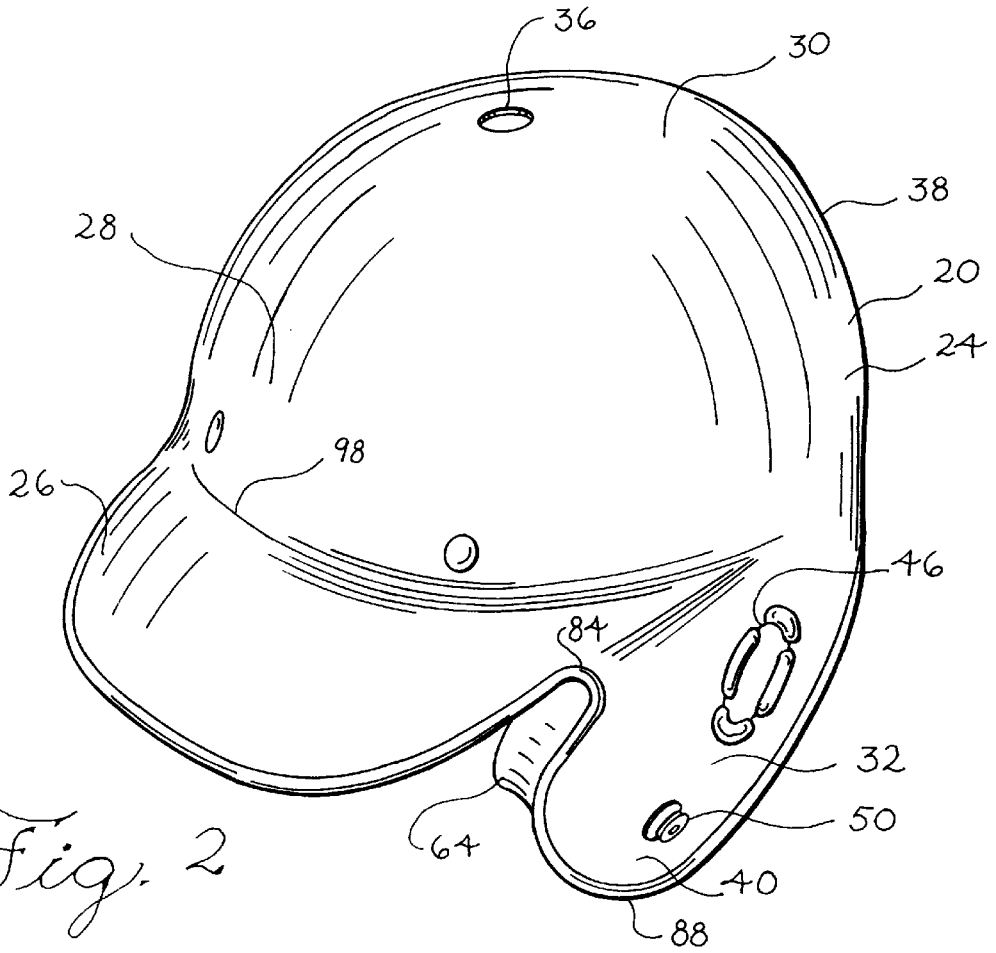
FIG. 2 shows a perspective view of a helmet according to the present invention.
Figure 3:
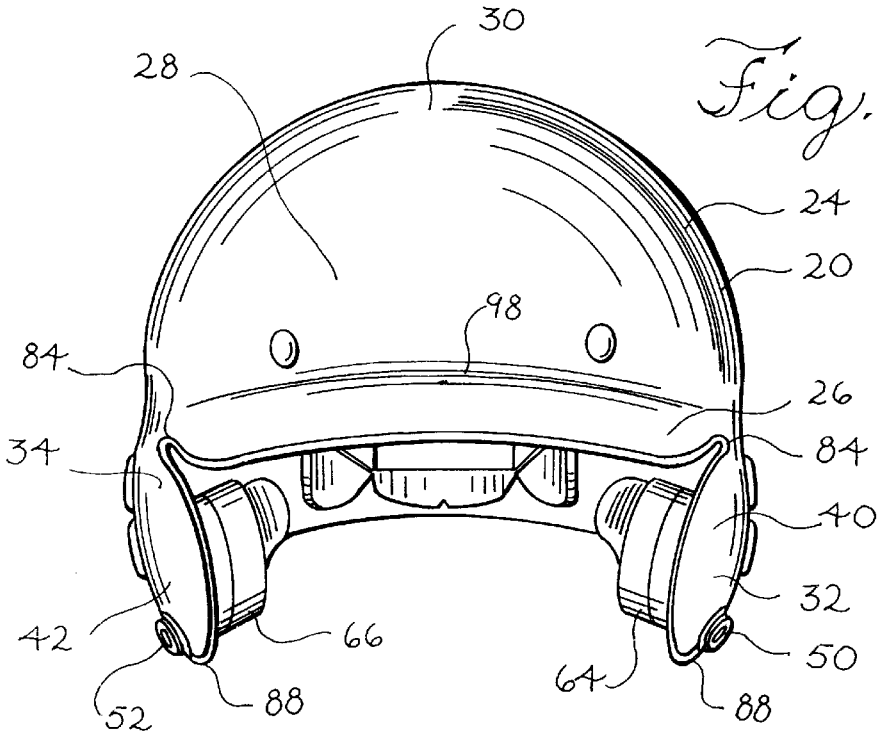
FIG. 3 shows a front view of the helmet of FIG. 2.
Figure 4:
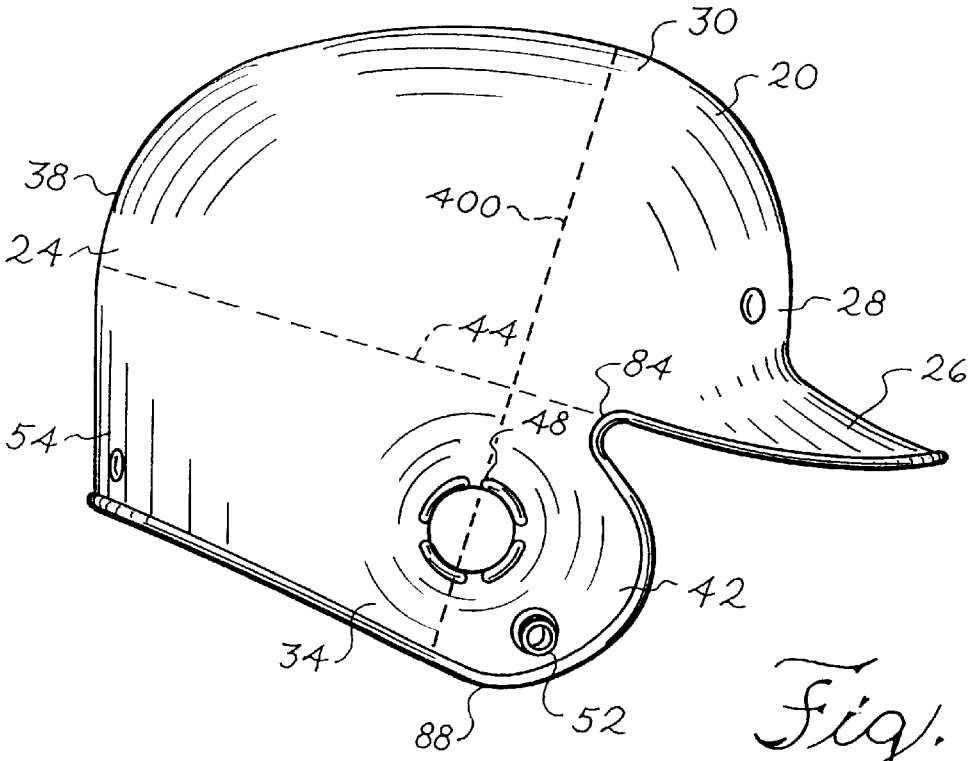
FIG. 4 shows a right side view of the helmet of FIG. 2.
Figure 5:
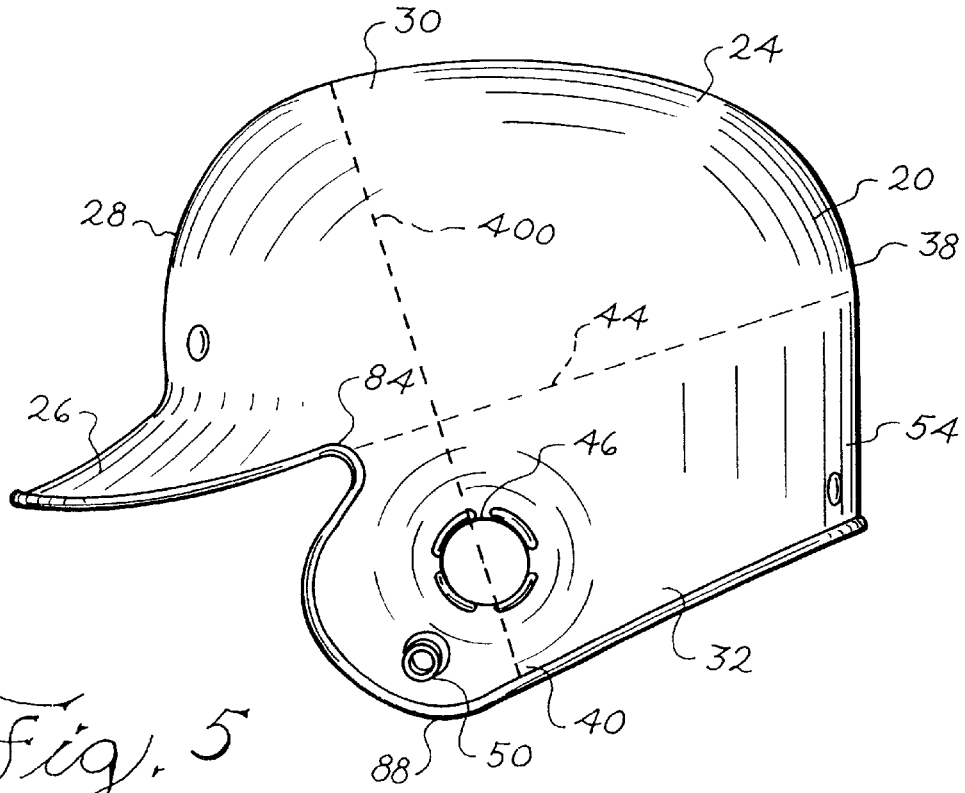
FIG. 5 shows a left side view of the helmet of FIG. 2.
Figure 6:
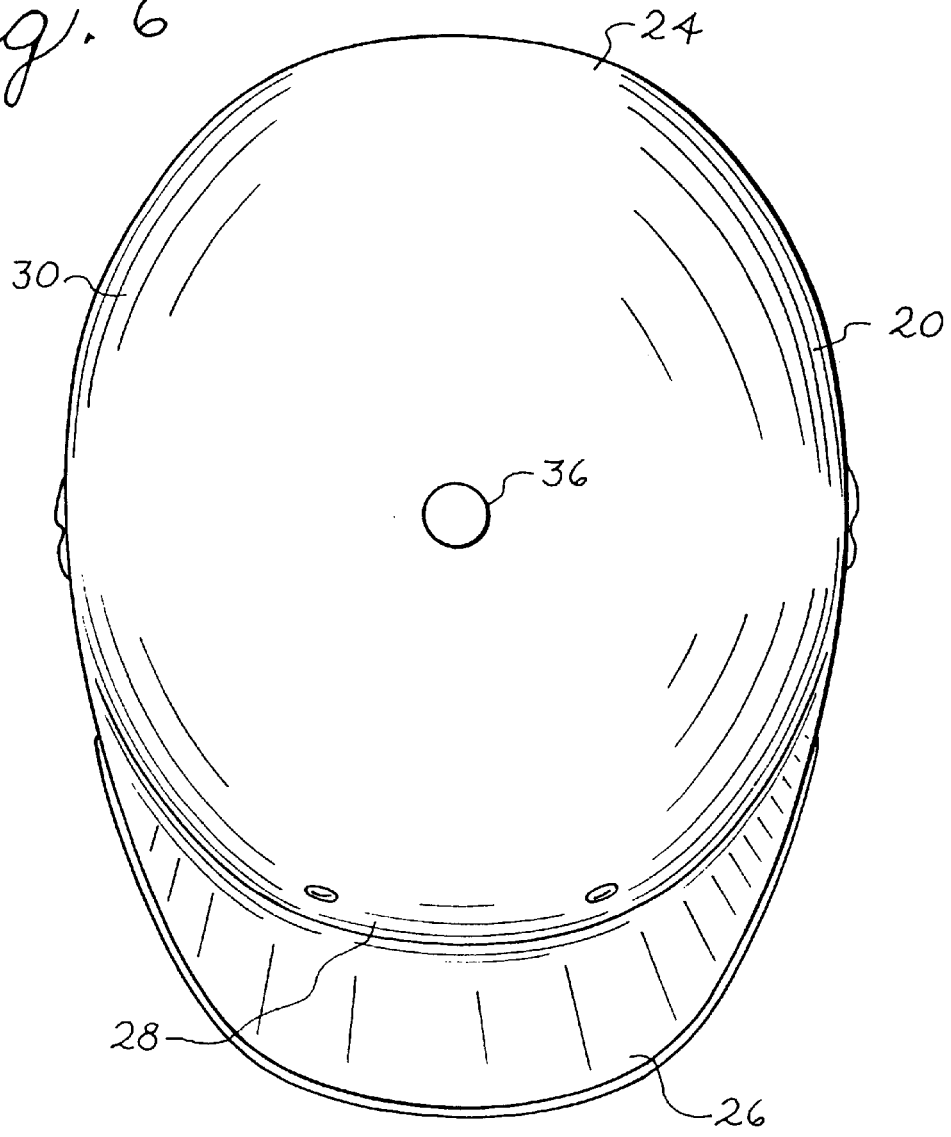
FIG. 6 shows a top view of the helmet of FIG. 2.

In a preferred embodiment, the shell 24 is made in a large size so as to accommodate head sizes ranging from size 6⅜ to size 7½ and has a weight ranging from about 475 grams to about 500 grams. Of course, other shell sizes are possible without departing from the spirit of the invention. The shell 24 preferably is of a standard make being used for baseball helmets made by Park View Manufacturing Corp. of Salem, Ill. under the trade names of AIR® Pro 2700, AIR® Pro 2788 and AIR® Pro 2800. As shown in FIGS. 2–7, the shell 24 includes a front bill 26 that is integrally attached to a front surface 28 and is oriented so that its edge substantially lies within a front bill plane 44 (see dashed lines). The front surface 28 is integrally attached to a top surface 30 and left and right side surfaces 32, 34, respectively. The top surface 30 preferably has a 0.5 inch diameter hole 36 drilled at the apex of the surface in order to allow air to circulate in and out of the interior of the helmet 20. The top surface 30 and the left and right side surfaces 32 and 34 are also integrally attached to a rear surface 38 shown in FIGS. 4 and 5. As shown in FIGS. 2, 4, and 5, the left and right side surfaces 32, 34 each have a corresponding ear flap 40, 42 that extends below the front bill plane 44 so as to provide protection for the batter's ears. The ear flaps 40 and 42 include circular ear holes 46 and 48 that are aligned with the ears of the batter so as to allow the batter to hear the umpire and the coaches of his or her team. Each ear flap 40, 42 has a steel snap stud 50, 52 attached thereto in a well known manner. The snap studs 50, 52 are well known in the art and are used to attach a chin strap (not shown) to the helmet 20 in a well known manner. It is understood that the snap studs 50, 52 may be replaced with long snap posts which are well known in the art. As shown in FIGS. 4 and 5, the ear flaps 40 and 42 are integrally attached to one another via a rear neck extension 54 that extends approximately 1.25 inches below the front bill plane 44.

To best understand the present invention it is necessary to look into the interior of the helmet 20 as shown in FIGS. 7–8. For example, as shown in FIG. 7A, the entire volume bounded by the front surface 28, the left and right side surfaces 32, 34, the rear surface 38 and the top surface 30 of the shell 24 define an interior space 56. In order to cushion the head 22, a number of pads 60, 62, 64, 66, 68, 70, 72 are attached to an interior surface 58 of the shell 24.

As shown in FIGS. 9A–E, the pads have a wide variety of shapes and sizes. For example, the side pads 60 and 62 have identical rectangular shapes preferably with a length of approximately 5.5 inches and a width of approximately 2.25 inches. The front edges 82 of the side pads 60 and 62 nearest the front surface 28 are spaced approximately 0.5 inches from the intersection points 84 where the front bill 26 meets the ear flaps 40 and 42. The ear pads 64 and 66 have identical crescent-like shapes which preferably have a length of approximately 4 inches and a width of about 1.5 inches. As shown in FIGS. 2, 3, 7A, 7B and 9B, the ear pads 64 and 66 are attached directly below the ear holes 46 and 48, respectively, so that the lower edges 86 of the ear pads 64 and 66 lie adjacent to the lower edges 88 of the ear flaps and an arcuate portion 90 of the upper edges 92 of the ear pads lie adjacent to a bottom portion of the corresponding ear hole. As shown in FIGS. 7A and 9C, a rectangular-like crown pad 68 is centered about the hole 36 so that its own 0.5 inch diameter hole 94 is aligned with the hole 36 in top surface 30. In a preferred embodiment, the pad 68 has a length of approximately 3.75 inches and a width of approximately 2.75 inches.

The front and rear portions of the interior surface 58 also have pads 70 and 72, respectively, attached thereto. As shown in FIG. 9D, the front pad 70 has a rectangular shape preferably having a length of approximately 8.75 inches and a width of approximately 2.25 inches. A lower edge 96 of the front pad 70 lies adjacent to a top edge 98 of the front bill 26 and is centered about a mid-sagittal plane 100 that bisects the shell 24 and lies along the mid-sagittal plane of the batter's head (the vertical plane of symmetry that is a perpendicular bisector of the line connecting the eyes of the batter) when in the interior space 56, as shown in FIG. 7A. The rear pad 72 also is centered about the mid-sagittal plane 100 and has a bottom edge 102 that lies adjacent to the bottom rear edge 104 of the shell 24. As shown in FIGS. 7A, 7B and 9E, the rear pad 72 has a trapezoidal shape that is bisected by the mid-sagittal plane 100 and has a base 106 preferably having a length of approximately 5.25 inches, a top 108 preferably having a length of approximately 3 inches and legs 110 and 112 having equal lengths of approximately 4.25 inches.

Figure 10:
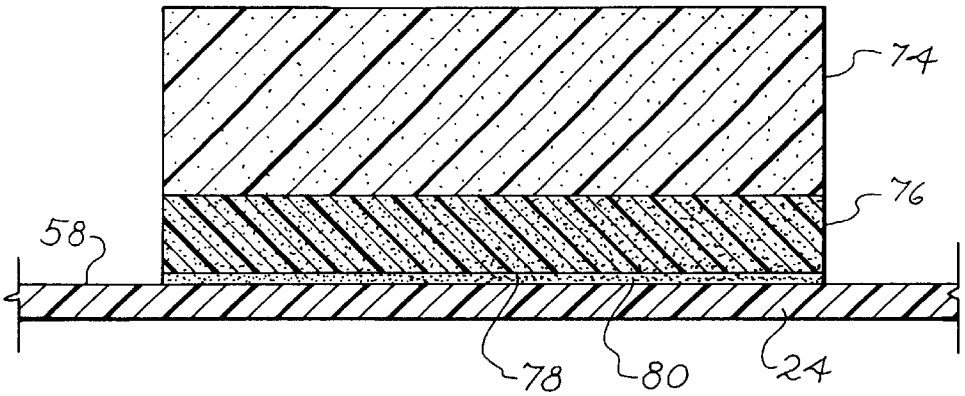
FIG. 10 schematically shows a side cross-sectional view of a pad attached to the helmet of FIG. 2.
Figure 11:
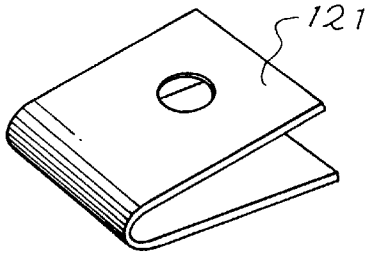
FIG. 11 shows a perspective view of rivet cover to be used with the helmet of FIGS. 2–10.
Figure 12:
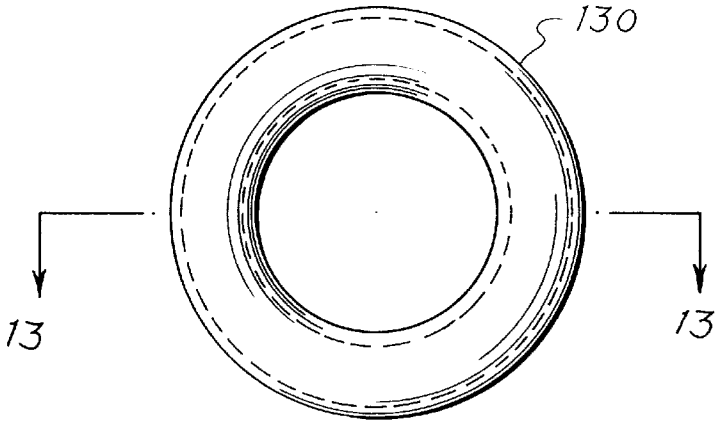
FIG. 12 shows a top view of grommet to be used with the helmet of FIGS. 2–10.
Figure 13:
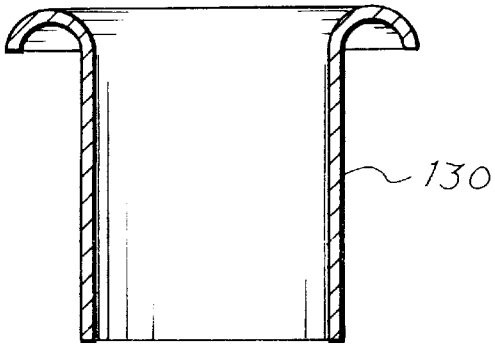
FIG. 13 shows a side cross-sectional view of the grommet of FIG. 12 taken along lines 13—13 of FIG. 12.

As schematically shown in FIG. 10, each pad preferably is of a two part construction with a polyurethane ester layer 74 laminated on top of an ethyl vinyl acetate (EVA) layer 76 in a well known manner. The EVA layer 76 preferably has a thickness of about 0.25 inches while the polyurethane ester layer 74 can have a thickness ranging from 0.125 inches to one inch. The laminated material made of layers 74 and 76 is available from Der-Tex Corporation of Lawrence, Mass. As shown in FIG. 10, the bottom surface 78 of the EVA layer 76 is attached to the interior surface 58 of the shell 24 by an adhesive 80, such as the adhesive sold by 3M of Minneapolis, Minn. under the trade name of FASTBOND Contact Adhesive #10.

As shown in FIGS. 9D and 9E, the front and rear pads 70 and 72 each have a pair of slots 114 and 116, respectively, that are formed in the bottom edges thereof. The slots 114 and 116 are formed so as to receive the one piece elastic strap 118 of FIGS. 7–8. The strap 118 has a free end portion 120 that is inserted into a rivet cover 121 (see FIG. 11) and placed adjacent to the interior surface of the front surface 28. A rivet 124 is then inserted through a hole in the front surface and engages the end portion 120 and the rivet cover 121 so as to attach the end portion 120 and rivet cover 121 to the front surface 28 of the shell 24. As best shown in FIG. 8A, the strap 118 extends towards the rear surface 38 along a first direction for a distance of approximately 7 inches so as to define a left side section 122. At the end of the left side section 122 closest to the rear surface 38, the strap 118 changes direction so that a second left section 124 of the strap 118 extends towards and is attached to the rear surface 38 along a second direction which varies by an angle β approximately 47 degrees relative to the original direction of the left side section 122 as shown in FIG. 8A. The second left side section 124 is attached to the rear surface by inserting a 0.5 inch long intermediate end 126 of the strap 118 into the left slot 116 of the rear pad 72 and into a rivet cover 121 (see FIG. 14). Next, a washer 128 made of high density polyethylene (HDPE) is placed over the end 126 and a 0.245 inch diameter brass grommet 130 (see FIGS. 11–13) is inserted through the washer 128, the end 126 and the rear surface 38. With the grommet 130 in place, a rivet 131 is inserted through the shell 24 and the grommet 130 so as to attach the intermediate end 126 of the strap 118 to the rear surface 38 of the shell 24. From the point of attachment of the intermediate end 126 of the strap 118 to the rear surface 38, the strap 118 changes direction once again, but this time a third section 132 of the strap 118 extends towards the front surface 28. At about 1.75 inches from the rear surface 38 of the shell 24, the third section 132 of the strap 118 is attached to both the left side section 122 and the second left side section 124 by sewing a size "D" black thread, preferably a thread sold under the trade name of Nymolex by Barbour Threads, Inc. of Birmingham, Ala., along the length of a line 134. Besides being attached to the left side section 122 and the second left side section 124, the third section 132 is integrally attached at line 134 to a left end of the rear support section 136 formed out of the strap 118 that is positioned approximately parallel to and approximately 1.75 inches from the rear surface 38 and approximately 8.25 inches from the front surface 28 of the shell 24.

The rear support section 136 has a length of approximately 2 inches and is supported by the rest of the strap 118 so as to be suspended from and not directly attached to the shell 24 so as to lie entirely within the interior space 56. In order to suspend the rear support section 136 within the interior space 56, the right end of the rear support section 136 is integrally attached to a fifth section 138 of the strap 118 which extends along a linear direction toward and into the right slot 116 of the rear pad 72. The fifth section 138 of the strap 118 is attached to a second intermediate end 140 which in turn is integrally attached to a sixth section (second right side section) 142 of the strap 118 which is integrally attached to a right side section 144 of the strap 118 where the sections 142 and 144 extend toward the front surface 28. The fifth section 138, the second intermediate end 140, the sixth section 142 and the right side section 144 have approximate lengths of 1.25 inches, 0.5 inches, 1.25 inches and 7 inches, respectively.

Note that the second intermediate end 140 is attached to the rear surface 38 via a rivet cover 121, washer 128, grommet 130 and rivet 131 in the same manner the intermediate end 126 is attached to the rear surface. The right end of the rear support section 136, the fifth section 138, the sixth section 142 and the right side section 144 are attached to each other along a common line 146 located approximately 1.75 inches from the rear surface 38 by sewing a size "D" black Nymolex thread along the length of the line 146. In addition, a free end portion 148 of the right side section 144 is inserted into the right slot 114 of the front pad 70 and attached to the front surface 28 via a rivet cover 121 and rivet 124 in the same manner that the free end portion 120 is attached to the front surface 28.

Figure 14:
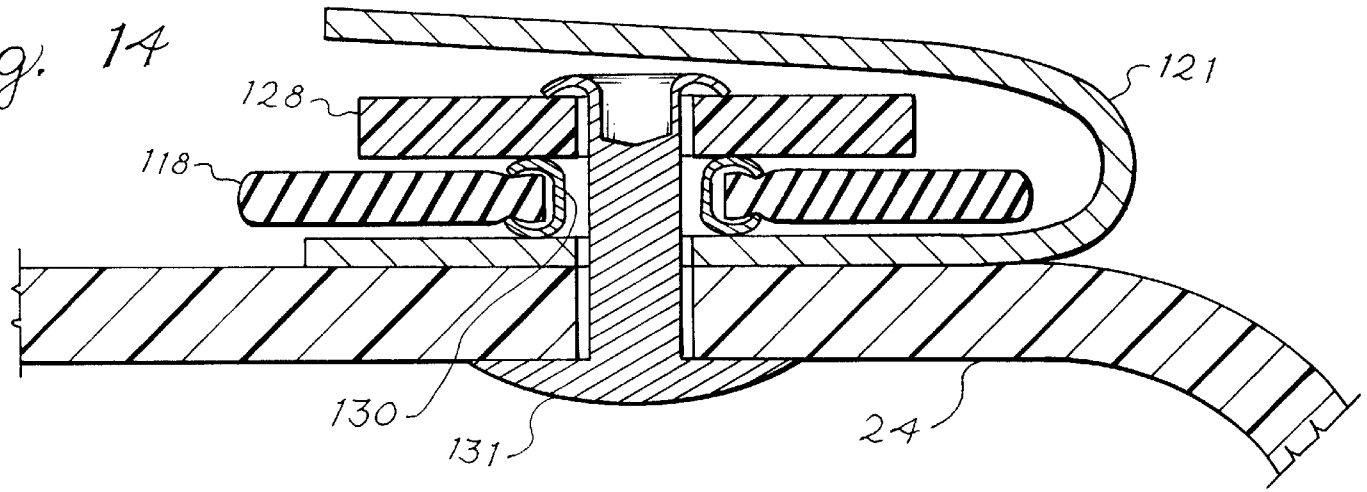
FIG. 14 shows a cross-sectional view of the attachment of the strap to the helmet of FIGS. 2–13.
Figure 15:
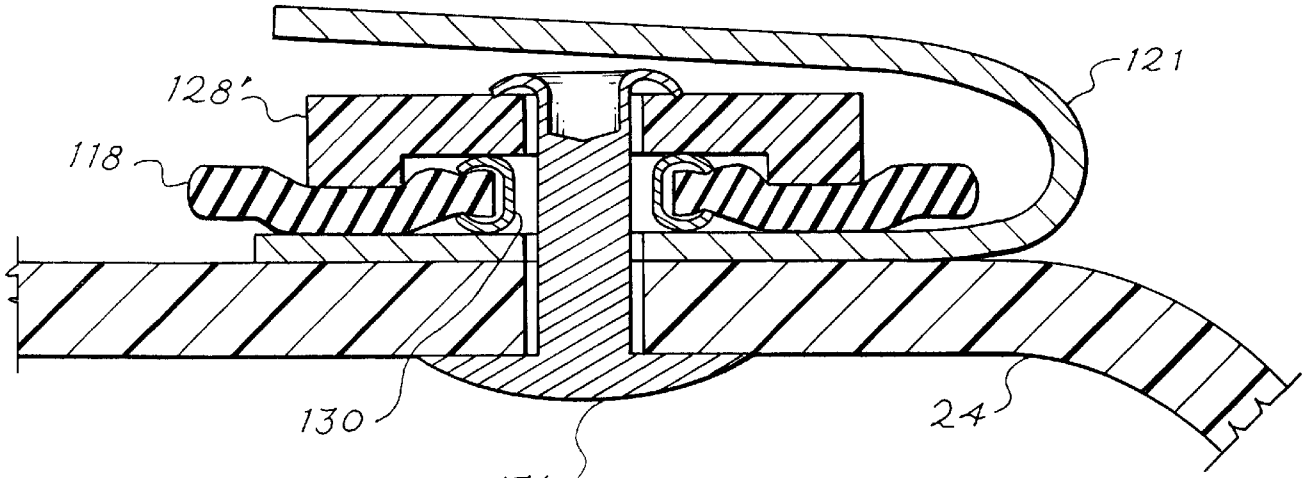
FIG. 15 shows a cross-sectional view of a second embodiment of an attachment of the strap to the helmet of FIGS. 2–13.

Note that the strap 118 may be attached to the rivets 124 at the front surface 28 by using the same washer 128 and grommet 130 combination used to attach the strap 118 to the rear surface 38. In addition, an alternate embodiment for attaching the strap 118 to the rear and front surfaces is shown in FIG. 15 where the washer 128 shown in FIG. 14 is replaced by a recessed washer 128' that pushes down on the strap 118 so as to increase the amount of strap area that contacts the rivet cover 118.

The strap 118 may be of various suitable materials and construction. In the illustrated example, the strap 118 has a width of approximately one inch, a thickness of approximately 0.08 inches and an unextended length of approximately 19.25 inches. The preferred material of the elastic strap 118 is a nylon or textured polyester cover surrounding and bound with an elastomer core of extruded round rubber inserted within the cover. The elastic strap 118 preferably has a maximum stretch ratio of 10:16 with about 100% recovery. The material content is approximately 70% polyester yarns and 30% rubber. An example of such an elastic strap 118 is the strap manufactured by Century Narrow Fabrics Co. Inc. of Birmingham, Ala. under the part number 1" ONF-#7007-BK. Other types of elastic straps may provide suitable results, and the above description is not intended to be limiting.

When the elastic strap 118 is attached to the front and rear surfaces 28 and 38 as described previously, the strap 118 is preferably of a continuous length and generally rises from the bottom edge of the rear surface 38 to just above the front bill 26 at the front surface 28 so as to define an angle of approximately 17 to 18 degrees below the front bill plane 44.

The above described strap 118 defines a harness 150 to receive the head 22 of the batter as shown in FIGS. 7A and 8A. The harness 150 can be described in many ways. First, a portion of the harness 150 forms a II-shaped receptor 152 positioned within the interior space 56 which has the shape of a capital Greek letter pi (II). For the purposes of this application, a II-shaped object is a trapezoid with one of the parallel base sides missing. In the embodiment of FIG. 7A, the II-shaped receptor 152 is defined by the left and right side sections 122, 144, respectively, and the rear support section 136. The II-shaped receptor 152 is symmetrical about the mid-sagittal plane 100 in that the plane 100 is a perpendicular bisector of the rear support section 136 and the left side section 122 and the right side section 144 are mirror images of one another with respect to the mid-sagittal plane 100. Of course, the left side of the rear support section 136 that is on the left side of the mid-sagittal plane 100, as viewed from above as in FIGS. 7A and 8A, is a mirror edge of the right side of the section 136 that is located on the right side of the mid-sagittal plane 100. As shown in FIGS. 7A and 8A, the left and right side sections 122 and 144 each define an angle a of approximately 100 degrees with the rear support section 136.

The II-shaped receptor 152 is suspended in the interior space 56 in part by a left rear attachment 154 and a right rear attachment 156 that are attached to the rear surface 38 of the shell 24 and extend from the rear surface 38 so as to be attached to the II-shaped receptor 152. The left and right rear attachments 154 and 156 are each triangular in shape. As shown in FIG. 7A, the triangular left rear attachment 154 is defined by the second left side section 124, the intermediate end 126 and the third section 132, where an apex of the left rear attachment is attached to the rear support section 136 at the line 134. The right rear attachment 156 is also triangular in shape since it is defined by the fifth section 138, the intermediate end 140 and the sixth section 142. Like the left rear attachment 154, an apex of the right rear attachment 156 is attached to the rear support section 136 at the line 146. As shown in FIGS. 7A and 8A, the left and right rear attachments 154 and 156 are mirror images of one another about the mid-sagittal plane 100.

Another way of describing the harness 150 is that it is generally H-shaped. The left side section 122 and the second side section 124 define a left side suspension section 158 that is attached to both the front and rear surfaces of the shell 24. Similarly, the right side section 144 and the second right side section 142 define a right side suspension section 160 that is attached to the front and rear surfaces of the shell 24. The rear support section 136 is suspended in the interior space 56 by being attached to the left and right side suspension sections 158 and 160. The rear support section 136 and the suspension sections define an H-like shape. The left and right side suspension sections 158 and 160 are mirror images of one another with respect to the mid-sagittal plane 100 that bisects the rear support section 136.

An example of the use of the batter's helmet 20 is shown in FIGS. 7B and 8B. In this case, the helmet 20 would be too large for the head 22, but for the harness 150. However, as shown in FIGS. 7B and 8B, the strap 118 of the harness 150 snugly cradles the sides and the rear of the head 22 and space the helmet shell 24 from the sides and the rear of the wearer's head 22. The brow of the head 22 is supported by the front pad 70. Thus, the strap 118, harness 150 and the pads 60, 64, 66, 68, 70, 72 can accommodate wear by players with differing sizes of head size. For example, if a person with head larger than the one shown in FIGS. 7B and 8B should wear the helmet 20, the strap 118 would stretch until such time that the head 22 contacted the side pads 60, 62, the ear pads 64, 66 and the rear pad 72, at which time the elastic strap 118 would lie smoothly against the pads.

The foregoing description is provided to illustrate the invention, and is not to be construed as a limitation. Numerous additions, substitutions and other changes can be made to the invention without departing from its scope as set forth in the appended claims. For example, the harness 150 can be made of separate elastic pieces that are sewn together. Each elastic piece would correspond to one or more of the sections 60, 144, the portions 124, 132, 138, 142 and the intermediate ends 126 and 140. The separate pieces may be made of the same material or different materials. Another version of the present invention would be to replace each of the triangular attachment portions 154 and 156 with a pair of elastic pieces that are attached to the rear surface 38 and the lines 134 and 146. The pair of elastic pieces would be made of a material and positioned so as to function in a similar manner as the attachment portions 154 and 156.

What is claimed is:

1. A helmet to be worn on a person's head, said helmet comprising:

a shell comprising a front surface, a rear surface, a first side surface and a second side surface, wherein said front, rear, first side and second side surfaces define an interior space;

a strap comprising a first end attached to said front surface of said shell and a second end attached to said front surface of said shell, wherein said strap forms a receptor within said interior space that is substantially in the shape of a trapezoid with one of the parallel base sides of said trapezoid not being directly attached to said shell, and the other of the parallel base sides of said trapezoid missing.

2. The helmet of claim 1, wherein said shell comprises a top surface.

3. The helmet of claim 1, wherein said strap comprises:

a first side section extending from said first end and attached to a first end of a rear support section; and a second side section extending from said second end and attached to a second end of said rear support section, wherein said rear support section is suspended from said shell and lies entirely within said interior space.

4. The helmet of claim 3, wherein said first side section and said rear support section define an angle of approximately 100 degrees.

5. The helmet of claim 4, wherein said second side section and said rear support section define an angle of approximately 100 degrees.

6. The helmet of claim 1, wherein said receptor defines a rear support section that is suspended from said shell and lies entirely within said interior space.

7. The helmet of claim 2, wherein said receptor defines a rear support section that is suspended from said shell and lies entirely within said interior space.

8. The helmet of claim 1, wherein said receptor is symmetrical with respect to a mid-sagittal plane that intersects said rear surface.

9. The helmet of claim 3, wherein said rear support section is symmetrical with respect to a mid-sagittal plane that intersects said rear surface.

10. The helmet of claim 9, wherein said mid-sagittal plane bisects said rear support section.

11. The helmet of claim 9, wherein said mid-sagittal plane is a perpendicular bisector of said rear support section.

12. The helmet of claim 1, wherein said strap further comprises:

a rear attachment that is attached to and extends from said receptor and is attached to said shell.

13. The helmet of claim 12, wherein said rear attachment is attached to said rear surface.

14. A helmet to be worn on a person's head, said helmet comprising:

a shell comprising a front surface, a rear surface, a first side surface and a second side surface, wherein said front, rear, first side and second side surfaces define an interior space;

a strap comprising:

a first end attached to said shell;

a first side section extending from said first end and attached to a first end of a rear support section;

a second end attached to said shell; and a second side section extending from said second end and attached to a second end of said rear support section wherein said rear support section is suspended from said shell, lies entirely within said interior space and is positioned approximately 1.75 inches from said rear surface of said shell; and wherein said strap forms a receptor within said interior space that is substantially in the shape of a trapezoid with one of the parallel base sides of said trapezoid missing.

15. A helmet to be worn on a person's head, said helmet comprising:

a shell comprising a top surface, front surface, a rear surface, a first side surface and a second side surface, wherein said front, rear, first side and second side surfaces define an interior space;

a strap comprising:

a first end attached to said shell;

a second end attached to said shell; and wherein said strap forms a receptor within said interior space that is substantially in the shape of a trapezoid with one of the parallel base sides of said trapezoid missing; and wherein said receptor defines a rear support section that is suspended from said shell and lies entirely within said interior space and is positioned approximately 8.25 inches from said front surface of said shell and approximately 1.75 inches from said rear surface of said shell.

16. A helmet to be worn on a person's head, said helmet comprising:

a shell comprising a top surface, front surface, a rear surface, a first side surface and a second side surface, wherein said front, rear, first side and second side surfaces define an interior space;

a strap comprising:

a first end attached to said shell;

a second end attached to said shell;

wherein said strap forms a receptor within said interior space that is substantially in the shape of a trapezoid with one of the parallel base sides of said trapezoid missing, and said strap further comprising a rear attachment that is attached to and extends from said receptor and is attached to said shell, said rear attachment is in the shape of a triangle, where an apex of said triangle is attached to said receptor.

17. A helmet to be worn on a person's head, said helmet comprising:

a shell comprising a front surface, a rear surface, a first side surface and a second side surface, wherein said front, rear, first side and second side surfaces define an interior space;

a strap comprising:

a first end attached to said shell;

a first side section extending from said first end and attached to a first end of a rear support section;

a second end attached to said shell;

a second side section extending from said second end and attached to a second end of said rear support section, wherein said rear support section is suspended from said shell, lies entirely within said interior space and wherein said strap forms a receptor within said interior space that is substantially in the shape of a trapezoid with one of the parallel base sides of said trapezoid missing; and a rear attachment that is attached to and extends from said first end of said rear support section and is attached to said shell.

18. The helmet of claim 17, wherein said rear attachment is attached to said rear surface.

19. The helmet of claim 17, wherein said rear attachment is in the shape of a triangle, where an apex of said triangle is attached to said first end of said rear support section.

20. The helmet of claim 17, wherein said rear support section is symmetrical with respect to a mid-sagittal plane that intersects said rear surface.

21. The helmet of claim 20, wherein said mid-sagittal plane bisects said rear support section.

22. The helmet of claim 20, wherein said mid-sagittal plane is a perpendicular bisector of said rear support section.

23. A helmet to be worn on a person's head, said helmet comprising:

a shell comprising a front surface, a rear surface, a first side surface and a second side surface, wherein said front, rear, first side and second side surfaces define an interior space;

a strap comprising:

a first side section attached to said shell;

a second side section attached to said shell; and a rear support portion attached to said first and second side sections and positioned entirely within said interior space without being directly attached to said shell, wherein said rear support portion is positioned approximately 1.75 inches from said rear surface of said shell.

24. A helmet to be worn on a person's head, said helmet comprising:

a shell comprising a front surface, a rear surface, a first side surface and a second side surface, wherein said front, rear, first side and second side surfaces define an interior space;

a strap comprising:

a first side section attached to said shell;

a second side section attached to said shell; and a rear support portion attached to said first and second side sections and positioned entirely within said interior space without being directly attached to said shell, wherein said rear support portion is positioned approximately 8.25 inches from said front surface of said shell and approximately 1.75 inches from said rear surface of said shell.

25. A helmet to be worn on a person's head, said helmet comprising:

a shell comprising a front surface, a rear surface, a first side surface and a second side surface, wherein said front, rear, first side and second side surfaces define an interior space;

a strap comprising:

a first suspension section comprising a first end attached to said front surface and a second end attached to said rear surface, a second suspension section comprising a third end attached to said front surface and a fourth end attached to said rear surface; and a rear support portion comprising a first end attached to said first suspension section of said strap and a second end attached to said second suspension section of said strap, wherein said first suspension section, said second suspension section and said rear support portion define a generally H-shaped harness.

26. The helmet of claim 25, wherein said rear support portion is symmetrical with respect to a mid-sagittal plane that intersects said rear surface.

27. The helmet of claim 26, wherein said mid-sagittal plane bisects said rear support section.

28. The helmet of claim 26, wherein said mid-sagittal plane is a perpendicular bisector of said rear support portion.

29. A helmet to be worn on a person's head, said helmet comprising:

a shell comprising a front surface, a rear surface, a first side surface and a second side surface, wherein said front, rear, first side and second side surfaces define an interior space;

a strap comprising:

a first side section attached to said shell;

a second side section attached to said shell;

a rear support portion attached to said first and second side sections and positioned entirely within said interior space without being directly attached to said shell; and a rear attachment that is attached to and extends from said rear support portion and is attached to said shell, wherein said rear attachment is in the shape of a triangle, where an apex of said triangle is attached to a first end of said rear support portion.

30. A helmet to be worn on a person's head, said helmet comprising:

a shell comprising a front surface, a rear surface, a first side surface and a second side surface, wherein said front, rear, first side and second side surfaces define an interior space;

a strap comprising:

a first suspension section comprising a first end attached to said front surface and a second end attached to said rear surface, a second suspension section comprising a third end attached to said front surface and a fourth end attached to said rear surface; and a rear support portion comprising a first end attached to said first suspension section of said strap and a second end attached to said second suspension section of said strap, wherein said rear support portion is positioned approximately 1.75 inches from said rear surface of said shell.

31. A helmet to be worn on a person's head, said helmet comprising:

a shell comprising a front surface, a rear surface, a first side surface and a second side surface, wherein said front, rear, first side and second side surfaces define an interior space;

a strap comprising:

a first suspension section comprising a first end attached to said front surface and a second end attached to said rear surface, a second suspension section comprising a third end attached to said front surface and a fourth end attached to said rear surface; and a rear support portion comprising a first end attached to said first suspension section of said strap and a second end attached to said second suspension section of said strap, wherein said rear support portion is positioned approximately 8.25 inches from said front surface of said shell and approximately 1.75 inches from said rear surface of said shell.

32. A helmet to be worn on a person's head, said helmet comprising:

a shell comprising a front surface, a rear surface, a first side surface and a second side surface, wherein said front, rear, first side and second side surfaces define an interior space;

a one-piece strap comprising:

a first section attached to said front surface and extending towards said rear surface along a first direction;

a second section integrally attached to said first section and extending towards said rear surface along a second direction;

a third section integrally attached to said second section and extending towards said front surface along a third direction;

a fourth section integrally attached to said third section and extending towards said first side surface along a fourth direction;

a fifth section integrally attached to said fourth section and extending towards said rear surface along a fifth direction;

a sixth section integrally attached to said fifth section and extending towards said front surface along a sixth direction; and a seventh section integrally attached to said sixth section and extending towards said front surface along a seventh direction and attached to said front surface.

33. The helmet of claim 32, wherein said fourth section is positioned approximately 1.75 inches from said rear surface of said shell.

34. The helmet of claim 32, wherein said fourth section is positioned approximately 8.25 inches from said front surface of said shell and approximately 1.75 inches from said rear surface of said shell.

35. The helmet of claim 32, wherein said first, second, third and fourth sections are attached to one another.

36. The helmet of claim 35, wherein said fourth, fifth, sixth and seventh sections are attached to one another.

37. The helmet of claim 32, wherein said second and third sections are attached to said rear surface.

38. The helmet of claim 37, wherein said fifth and sixth sections are attached to said rear surface.

39. The helmet of claim 32, wherein said first and seventh sections have lengths that are equal.

40. The helmet of claim 32, wherein said second and sixth sections have lengths that are equal.

41. The helmet of claim 32, wherein said third and fifth sections have lengths that are equal.

42. The helmet of claim 32, wherein said fourth section is symmetrical with respect to a mid-sagittal plane that intersects said rear surface.

43. The helmet of claim 42, wherein said mid-sagittal plane bisects said fourth section.

44. The helmet of claim 42, wherein said mid-sagittal plane is a perpendicular bisector of said fourth section.

45. The helmet of claim 32, wherein said first, second, third, fourth, fifth, sixth and seventh sections are symmetrical with respect to a mid-sagittal plane that intersects said rear surface.

46. The helmet of claim 45, wherein said mid-sagittal plane bisects said fourth section.

47. The helmet of claim 42, wherein said mid-sagittal plane is a perpendicular bisector of said fourth section.

48. A helmet to be worn on a person's head, said helmet comprising:

a shell comprising a front surface, a rear surface, a first side surface and a second side surface, wherein said front, rear, first side and second side surfaces define an interior space;

a strap comprising:

a first side section attached to said shell;

a second side section attached to said shell;

a rear support section attached to said first and second side sections and positioned entirely within said interior space without being directly attached to said shell;

wherein said first side section is attached to said rear surface at a first position that is rearward of said rear support section; and said second side section is attached to said rear surface at a second position that is spaced from said first position and is rearward of said rear support section.

49. A helmet to be worn on a person's head, said helmet comprising:

a shell comprising a front surface, a rear surface, a first side surface and a second side surface, wherein said front, rear, first side and second side surfaces define an interior space;

a strap comprising:

a first side section attached to said shell;

a second side section attached to side shell;

a rear support section attached to side first and second side sections and positioned entirely within said interior space without being directly attached to said shell;

wherein said first side section and said second side section are attached to said front surface, and said rear support section is positioned nearer to said rear surface than said front surface; and wherein said first side section is attached to said rear surface at a first position that is rearward of said rear support section; and said second side section is attached to said rear surface at a second position that is spaced from said first position and is rearward of said rear support section.

50. A helmet to be worn on a person's head, said helmet comprising:

a shell comprising a rear surface, a first side surface and a second side surface, wherein said rear, first side and second side surfaces define an interior space;

a strap comprising a first end attached to said shell and a second end attached to said shell, wherein said strap forms a receptor within said interior space that is substantially in the shape of a trapezoid with one of the parallel base sides of said trapezoid not being directly attached to said shell, and the other of the parallel base sides of said trapezoid missing, wherein there are no other straps positioned further from said rear surface than said strap.

51. The helmet of claim 50, wherein said strap comprises:

a first side section extending from said first end and attached to a first end of a rear support portion; and a second side section extending from said second end and attached to a second end of said rear support portion, wherein said rear support portion is suspended from said shell and lies entirely within said interior portion.

52. The helmet of claim 50, wherein said one of said base sides of said trapezoid defines a rear support portion that is suspended from said shell and lies entirely within said interior portion.

53. The helmet of claim 50, wherein said strap further comprises:

a rear attachment portion that is attached to and extends from said receptor and is attached to said shell.

54. The helmet of claim 53, wherein said rear attachment portion is attached to said rear surface.

55. The helmet of claim 53, wherein said rear attachment portion is in the shape of a triangle, where an apex of said triangle is attached to said receptor.

56. A helmet to be worn on a person's head, said helmet comprising:

a shell comprising a rear surface, a first side surface and a second side surface, wherein said rear, first side and second side surfaces define an interior space;

a strap comprising:

a first side section attached to said shell;

a second side section attached to said shell; and a rear support section attached to said first and second side sections and positioned entirely within said interior space without being directly attached to said shell, wherein there are no other straps positioned further from said rear surface than said strap.

57. The helmet of claim 56, wherein said shell comprises a top surface.

58. The helmet of claim 56, wherein said first side section extends in a linear direction and said rear support section extends in a second linear direction, wherein said first side section and said rear support section define an angle of approximately 100 degrees.

59. The helmet of claim 56, wherein said rear support section is symmetrical with respect to a mid-sagittal plane that intersects said rear surface.

60. The helmet of claim 59, wherein said mid-sagittal plane bisects said rear support section.

61. The helmet of claim 59, wherein said mid-sagittal plane is a perpendicular bisector of said rear support section.

62. The helmet of claim 56, wherein said strap further comprises:

a rear attachment portion that is attached to and extends from said rear support section and is attached to said shell.

63. The helmet of claim 62, wherein said rear attachment portion is attached to said rear surface.

64. The helmet of claim 62, wherein said rear attachment portion is in the shape of a triangle, where an apex of said triangle is attached to said first end of said rear support section.

* * * * *

UNITED STATES PATENT AND TRADEMARK OFFICE

CERTIFICATE OF CORRECTION

PATENT NO. : 6,128,786
DATED : October 10, 2000
INVENTOR(S) : Larry E. Maddux et al.

It is certified that error appears in the above-identified patent and that said Letters Patent is hereby corrected as shown below:

Claim 49,
Line 9, change "side shell" to -- said shell --.
Line 10, change "side" to -- said --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*